United States Patent [19]

Schneider

[11] Patent Number: 4,719,532

[45] Date of Patent: Jan. 12, 1988

[54] ELECTRICAL CONTROLLER

[76] Inventor: Russell E. Schneider, 860 Shorewood Dr., East Troy, Wis. 53130

[21] Appl. No.: 833,899

[22] Filed: Feb. 26, 1986

[51] Int. Cl.[4] ..... H01H 47/00; H01H 9/00

[52] U.S. Cl. ..... 361/189; 361/191

[58] Field of Search ..... 361/160, 173, 189, 190, 361/191, 192; 307/89, 90, 115, 116, 139; 340/531, 532; 222/266

[56] References Cited

U.S. PATENT DOCUMENTS

| | | | |
|---|---|---|---|
| 3,696,364 | 10/1972 | Lavelle | 340/531 |
| 3,824,435 | 7/1974 | Sebille et al. | 361/191 |
| 4,225,808 | 9/1980 | Saraceni | 307/116 |
| 4,292,542 | 9/1981 | Bajka | 361/191 |
| 4,390,870 | 6/1983 | Micheal | 307/116 |

*Primary Examiner*—L. T. Hix
*Assistant Examiner*—David Porterfield
*Attorney, Agent, or Firm*—Michael, Best & Friedrich

[57] ABSTRACT

An electrical controller for actuating a number of electrical devices in accordance with control inputs received from a number of control input sources includes a number of optical isolators having inputs coupled to the control input sources. The optical isolators function to electrically isolate each of the control input sources from each other and to provide individual control voltages corresponding to the control inputs received from the control input sources. The outputs of the optical isolators are coupled through a user-actuable matrix switch to the coils of a number of relays which, in turn, control the electrical devices. Through various settings of the matrix switch, various ones of the electrical devices can be actuated in response to control inputs received from particular ones of the control input sources. Electrical isolation is maintained among the control input sources to avoid the development of undesirable feedbacks to the non-actuated control input sources.

17 Claims, 2 Drawing Figures

ELECTRICAL CONTROLLER

BACKGROUND OF THE INVENTION

This invention relates generally to controllers for controlling a number of electrical devices in response to control inputs received from a number of control input sources, and, more particularly, to such an electrical controller wherein electrical isolation is maintained between each of the control input sources.

The need to control a number of electrical devices in response to control inputs received from a number of sources, and, in particular, to control relatively few electrical devices in response to control inputs received from relatively many sources, can occur in a variety of control system installations. In automative gasoline and diesel-fuel filling stations, for example, several individual fuel hoses or dispensers are typically supplied with fuel provided from a single submersible pump fitted to a common underground storage tank. In larger filling stations, it is not uncommon for as many as eight underground storage tanks to supply fuel to as many as forty-eight hoses. Thus, several control input sources can exist for actuating the submersible pump of each storage tank.

To provide for the selective actuation of individual submersible pumps in response to control inputs received from a number of sources, various systems have been developed. In one such system, individual electrical switches, associated with each of the hoses or dispensers supplied from a common tank, are commonly connected to each other and to the coil of an electrical relay which controls the application of power to a submersible pump fitted to the tank. Although this system is effective in inexpensively implementing the desired control effect, it suffers the serious disadvantage of promoting undesirable "feedbacks" which render all of the unused dispensers electrically "hot" whenever the switch of any one dispenser is closed. In the event it becomes necessary to remove a fuel dispenser from service for purposes of maintenance, repair, or to avoid the creation of a hazardous condition following, for example, an accidental collision between an automobile and a dispenser, the potential for the occurrence of such feedbacks requires that each of the remaining, functioning dispensers, which are connected to the common relay, be shut down also. In a busy station, the need to shut down otherwise fully functional dispensers can have serious adverse economic consequences for the filling station operator.

To avoid the development of such undesirable feedbacks, individual relays, coupled to a common relay for actuating a single submersible pump, can be individually controlled by the switches associated with each hose or dispenser. Although effective, the cost of the relays and additional wiring associated with this approach can be considerable.

In view of the foregoing, it is a general object of the invention to provide a new and improved electrical controller for controlling several electrical devices in response to control inputs received from several sources.

It is a further object of the present invention to provide an electrical controller wherein undesirable feedbacks to unactuated ones of the control input sources are avoided.

It is still another object of the present invention to provide an electrical controller which can be implemented without considerable expense in terms of parts, time and labor.

SUMMARY OF THE INVENTION

The invention provides an electrical controller for controlling a plurality of electrical devices in accordance with control inputs received from a plurality of control input sources. Isolating means, coupled to the control input sources, are provided for electrically isolating the control input sources from each other and for developing individual control voltages corresponding to the individual control inputs developed by the individual control input sources. A plurality of output means, uniquely associated with individual ones of the electrical devices, are provided for actuating individual ones of the electrical devices in response to the application of the control voltages. Selector means are provided for selectively coupling the isolating means to individual ones of the output means in order to apply the control voltages to the output means and thereby actuate individual ones of the electrical devices in response to generation of the control inputs by selected ones of the control input sources.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
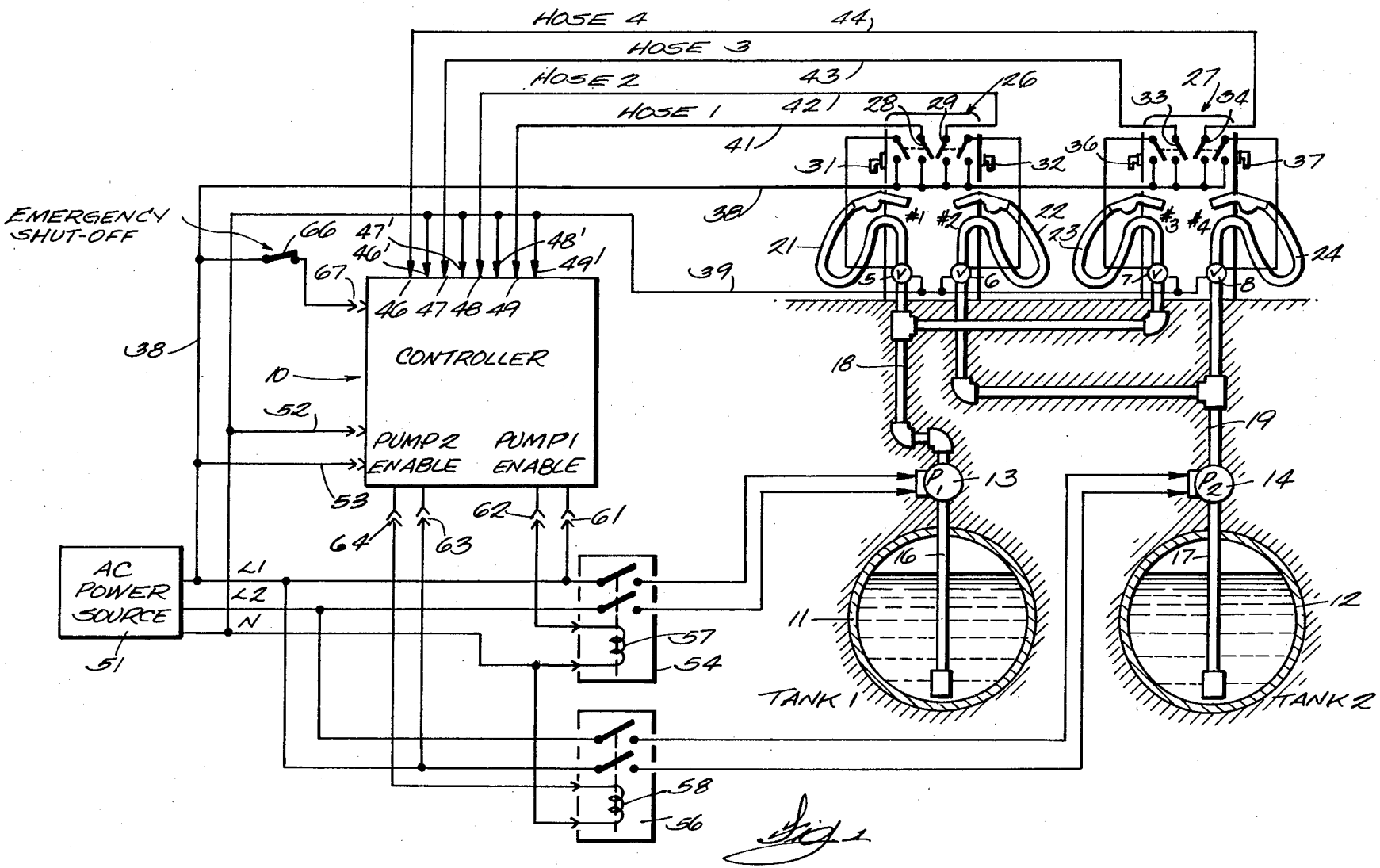
FIG. 1 is a simplified block diagram of a two-tank, four-hose, automotive filling station having a pair of submersible pumps operated by an electrical controller constructed in accordance with the invention.

Referring to the drawings and in particular to FIG. 1, a two-tank, four-hose, automotive filling or service station, having an electrical controller 10 constructed in accordance with the invention, is illustrated. To accomodate different types of vehicular fuels, such as diesel fuel and various grades of gasoline, the filling station is provided with a pair of underground main storage tanks 11 and 12 (labeled "Tank 1" and "Tank 2") which are each fitted with electrically driven submersible pumps 13 and 14 respectively. Each pump includes a input conduit, 16 and 17, extending into its associated storage tank, and an outlet conduit, 18 and 19, through which fuel is discharged when the pump is actuated. Above-ground, the filling station is provided with four hoses 21, 22, 23 and 24 mounted to a pair of free-standing, dual-hose dispenser units 26 and 27. Preferably, outlet conduit 18 is coupled through individual solenoid-controlled valves 5 and 7 to the first and third dispensers (labeled #1 and #3), while outlet conduit 19 is coupled through individual solenoid controlled-valves 6 and 8 to the second and fourth dispensers (labeled #2 and #4) as shown, such that both fuel types are available at each of the dispenser units 26 and 27.

The actuation of each of the first and second dispensers is independently controlled by means of a pair of double-pole switches 28 and 29 which, in turn, are acutated by means of a pair of user-actuable control handles 31 and 32 mounted on opposite sides of dispenser unit 26 adjacent hoses 21 and 22 respectively. Similar switches 33 and 34, for controlling the operation of the third and fourth dispensers respectively, are actuated by means of similar control handles 36 and 37 mounted on opposite sides of dispenser unit 27 adjacent hoses 23 and 24.

When fuel is to be dispensed from underground tank 11 through either hose 21 or hose 23, it is necessary that submersible pump 13 be actuated. Similarly, pump 14 must be actuated in order to dispense fuel from underground tank 12 through either hose 22 or hose 24. Actuation of pumps 13 and 14 is controlled by means of switches 28, 29, 33 and 34 in conjunction with the electrical controller 10 constructed in accordance with the invention. Switches 28, 29, 33 and 34 are also coupled to solenoid valves 5, 6, 7 and 8 such that fuel can only be dispensed through a hose whose associated switch control handle has been actuated.

As further illustrated in FIG. 1, one contact of each pole of each of the switches 28, 29, 33 and 34 is connected through a single common conductor 38 to a single power source. The remaining contacts of switches 28, 29, 33 and 34 are individually connected through separate conductors 41, 42, 43 and 44 to separate control inputs 49, 48, 47 and 46 respectively on controller 10. Alternating current (AC) power, for operating controller 10, is provided by an AC power source 51 which is coupled to controller 10 through a pair of conductors 52 and 53. AC power source 51 is also coupled through the normally open contacts of a first double-pole single-throw relay 54 to submersible pump 13 and through the normally open contacts of a second double-pole single-throw relay 56 to submersible pump 14. The coils 57 and 58 of relays 54 and 56 respectively are coupled to a pair of "Pump Enable" outputs provided by controller 10 through output terminals 61, 62, 63 and 64.

When dispenser control switch 28 is closed, a current is applied to controller 10 through control input 49. Similarly, closure of dispenser control switches 29, 33 and 34 results in the application of individual control currents to control inputs 48, 47 and 46 respectively.

In response to closure of switches 28 and 33, controller 10 functions to actuate submersible pump 13. To this end, a control current is developed at the "Pump 1 Enable" output of controller 10 and is passed through coil 57 to actuate relay 54. When relay 54 is thus actuated, the normally open relay contacts close and thereby permit current from the AC power source 51 to pass to the submersible pump 13. Similarly, when either dispenser switch 29 or 34 is closed, an actuating current is applied to the coil 58 of relay 56 through the "Pump 2 Enable" output of controller 10 in order to close the contacts of relay 56 and thereby apply AC power to submersible pump 14. It is a feature of the present invention that conductors 41–44, and the switches to which they are connected, remain electrically isolated from each other at all times regardless of the position of switches 28, 29, 33 and 34, and regardless of whether pumps 13 and 14 are actuated.

In order to provide a means by which power to pumps 13 and 14 can be quickly removed in the event of an emergency, an "emergency shut-off" switch 66 is included. Switch 66 is connected, at one end, to one active or "hot" side L1 of power source 51 and is coupled to controller 10 through an input terminal 67. When the normally closed contacts of switch 66 are opened, current to relay coils 57 and 58 is removed regardless of the position of the dispenser control switches 28, 29, 33 and 34.

Figure 2:
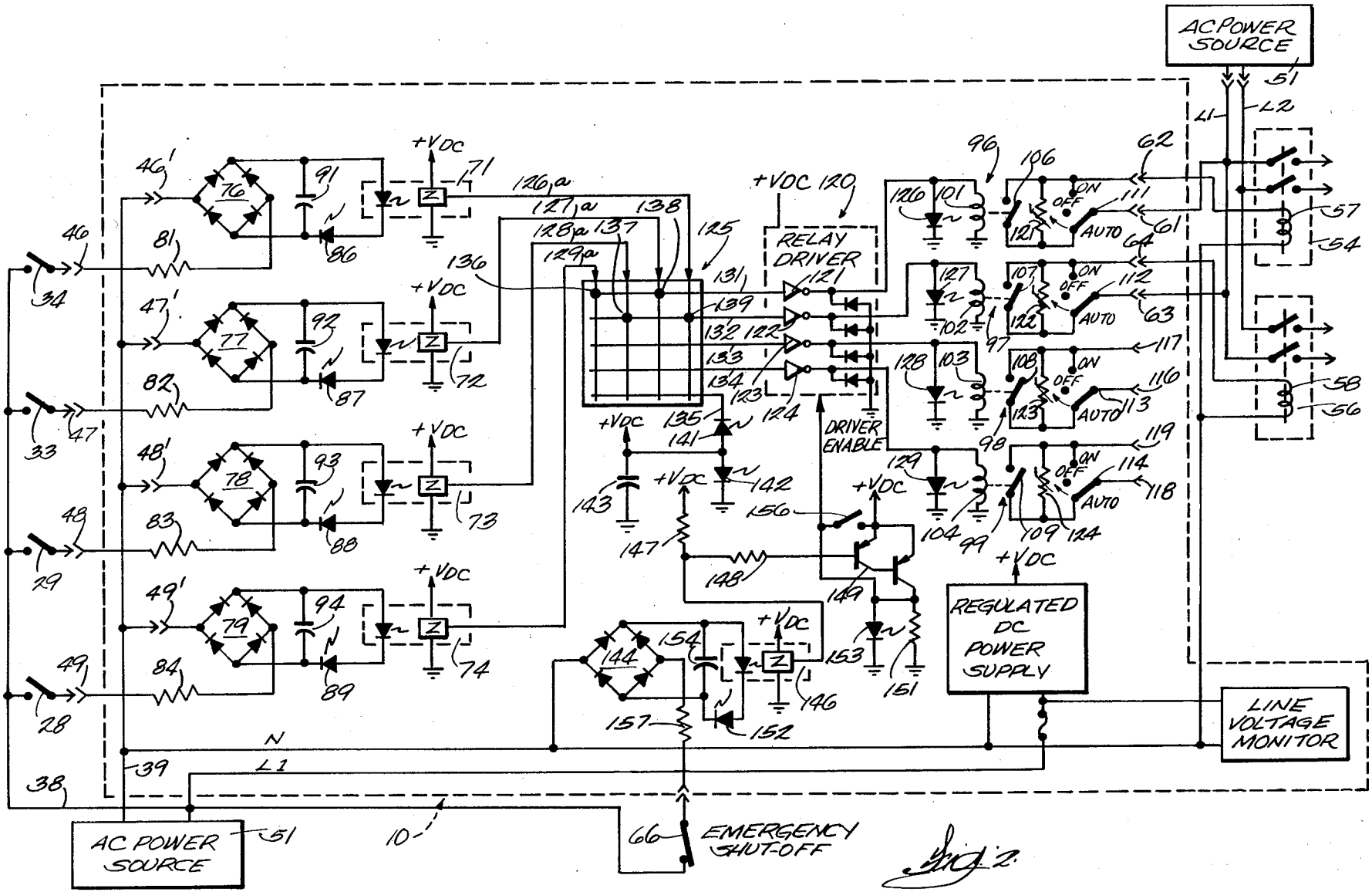
FIG. 2 is an electrical schematic diagram useful in understanding the construction and operation of the electrical controller illustrated in FIG. 1.

The construction and operation of electrical controller 10 can best be understood by reference to the electrical schematic diagram of FIG. 2. As illustrated therein, controller 10 includes a regulated DC power supply 69, of known construction, having its input connected through a fuse 70 to the AC power source 51. A regulated DC voltage ($+V_{DC}$) is provided at the output of power supply 69 for operating various circuitry within controller 10.

Referring further to FIG. 2, one active or "hot" side L1 of the AC power source 51 is coupled through conductor 38 to the commonly connected contacts of dispenser control switches 28, 29, 33 and 34. The remaining contacts of the switches are individually coupled to controller 10 through control input terminals 46–49. Individual control inputs, comprising alternating currents from AC power source 51, are thus applied to controller 10 through control input terminals 46–49 in response to closure of switches 28, 29, 33 and 34.

To prevent the occurrence of "feedbacks" in response to closure of any one of the dispenser control switches 28, 29, 33 or 34, isolating means for electrically isolating the control input sources from each other and for developing control voltages corresponding to the individual control inputs received on control input terminals 46–49 are provided in the form of a plurality of optical isolators 71–74 which are individually coupled to control input terminals 46–49. To convert the alternating current control inputs into a form suitable for operating the optical isolators 71–74, a plurality of full-wave bridge rectifiers 76–79, of known construction, are also provided. As illustrated, one input terminal of bridge rectifier 76 is connected through a resistor 81 to control input terminal 46, while single input terminals of the remaining rectifiers 77–79 are individually connected through resistors 82–84 to control input terminals 47–79 respectively. Preferably, resistors 81–84 are connected to the "hot" side of power source 51 in order to minimize the presence of high voltages within controller 10. The remaining input terminals of rectifiers 76–79 are individually coupled to the remaining neutral side of the AC power source 51 through terminals 46′–49′ respectively. The outputs of rectifiers 76–79 are respectively coupled to the inputs of optical isolators 71–74 through individual, forward biased, light emitting diodes (LED's) 86–89. A plurality of filter capacitors 91–94 are individually connected across the outputs of rectifiers 76–79 and function to filter the output of each rectifier such that a substantially steady DC voltage is provided in response to closure of switches 28, 29, 33 or 34.

When switches 28, 29, 33 and 34 are each open, bridge rectifiers 76–79 are each de-energized and the outputs of optical isolators 71–74 are each biased high. Upon closure of any one of the dispenser control switches 28, 29, 33 or 34, a DC voltage is developed at the output of the associated bridge rectifier coupled thereto. This DC voltage, in turn, actuates the optical isolator to which it is applied with the further effect that the output of the isolator is biased low. Accordingly, a plurality of control voltages, individually indicative of the position of dispenser control switches 28, 29, 33 and 34, are provided at the outputs of optical isolator 71–74. The control voltages thus provide a logic transition or voltage level change in response to a change in the position of the dispenser control switches 28, 29, 33, and 34. LED's 86–89 illuminate in response to closure of their associated dispenser control switches and function to aid system repair by providing a visual indication in response to proper circuit operation.

To enable controller 10 to actuate individual ones of a plurality of electrical devices in response to the generation of the control voltages at the outputs of optical isolators 71–74, output means are provided in the form of a plurality of single-pole single-throw relays 96–99. Each relay includes a coil 101–104 and a set of normally open switch contacts 106–109 which close in response to the passage of current through the associated relay coil.

As illustrated, one contact of relay contact set 106 is coupled through output terminal 62 to one end of the coil 57 of pump control relay 54. The other end of coil 57 is connected to the neutral line 39 of the AC power source 51. Similarly, one contact of relay contact set 107 is coupled through terminal 64 to one end of the coil 58 of pump control relay 56. The remaining end of coil 58 is connected to neutral line 39. The remaining contact of relay contact set 106 is connected to one position of a multiple position switch 111 while the remaining contact of relay contact set 107 is connected to one position of an additional multiple position switch 112. The wiper arms of switches 111 and 112 are each connected to on of the "hot" conductors L1 of the power source 51.

As further illustrated, two sets of additional output terminals 116, 117 and 118, 119 are included. Terminal 117 is connected to one contact of relay contract set 108, the remaining contact of which is coupled through one position of a multiple position switch 113 to terminal 116. Similarly, terminal 119 is connected to one contact of relay contract set 109, the remaining contact of which is coupled through one position of an additional multiple position switch 114 to output terminal 118.

In the example illustrated, output terminals 116–119 are unused but provide the capability for expansion in the event additional electrical devices are to be operated by the controller. A plurality of voltage-sensitive variable resistors (Varistors) 121–124 are respectively connected across relay contacts 106–109 and function to suppress transient voltages developed in response to relay contact bounce.

Relay contacts 106–109 close in response to the passage of current through their associated relay coils 101–104 and function to couple the AC power source 51 to particular pairs of the controller output terminals 61–64 and 116–119. Such currents are generated in accordance with the logic transitions occurring at the outputs of the optical isolators 71–74. To this end, controller 10 includes a multiple relay driver 120 containing four individual inverting driver amplifiers 121–124. The outputs of driver amplilfiers 121–124 are respectively individually connected to one side of each of the relay coils 101–104. The opposite sides of the relay coils are connected to circuit ground. Diagnostic LED's 126–129, which provide a visual indication of normal circuit operation, are individually connected across relay coils 101–104. In response to the application of a low-logic voltage at its input, relay driver amplifier 121 functions to provide sufficient current at its output to energize relay coil 101, and thereby close relay contacts 106, and to actuate LED 126. Similarly, relay driver amplifiers 122–124 function to actuate relay contacts 107–109 and illuminate LED's 127–129.

In order to enhance system flexibility and to permit various combinations of electrical devices to be controlled in response to various combinations of control inputs, selector means are provided for selectively coupling the control voltages developed by optical isolators 71–74 to the inputs of relay driver amplifiers 121–124. In the illustrated embodiment, such selector means are provided in the form of a user-actuable matrix switch 125 of known construction. Switch 125 includes four input lines 126*a*–129*a*, five output lines 131–135 and four user-actuable switch position selectors 136–139. Input lines 126*a*–129*a* are respectively connected to the outputs of optical isolators 71–74, and output lines 131–134 are respectively connected to the inputs of relay driver amplifiers 121–124.

Matrix switch 125 functions to electrically connect individual ones of input lines 126–129 with individual ones of output lines 131–135 in accordance with the set positions of the switch position selectors 136–139. When the switch position selectors 136–139 are positioned as shown, the outputs of optical isolators 72 and 74 are both connected to the input of relay driver amplifier 121, while the outputs of optical isolators 71 and 73 are both connected to the input of relay driver amplifier 122. Thus, closure of either dispenser control switch 33 or 28 results in closure of relay contacts 106, while closure of either dispenser control switch 34 or 29 results in closure of relay contact 107. It will be appreciated that the switch position selectors can be set in various combinations such that some, all, or none of the relay contacts 106–109 close in response to closure of any or all of the dispenser control switches 28, 29, 33 or 34.

To provide a further measure of control over the electrical devices which are to be operated in accordance with the individual control inputs, switches 111–114 can be individually set in one of three positions. In one position, labeled "On" the wiper of the switch, which is coupled directly to one side L1 of the AC power source 51, causes the full AC voltage to appear across the associated controller output terminals and thereby continuously actuate the electrical device connected thereto regardless of the positions of the dispenser control switches 28, 29, 33 or 34 and regardless of the position of the switch position selectors 136–139. In the middle switch position, labeled "Off," the switch wiper is electrically disconnected from all circuitry and the electrical device connected to the associated controller output terminals remains continuously deactivated regardless of the positions of the other switches. In the lowermost position, labeled "Auto" the electrical devices are controlled in accordance with the closure of the associated relay contacts 106–109, which is, in turn, controlled by switches 28, 29, 33, and 34 and switch positions selectors 136–139. Preferably, the wipers of switches 111–114 are connected to the same power source 51 which provides power to the submersible pumps 13 and 14. This assures that when the source is disconnected for such purposes as pump repair, no power will be available which can accidently result in closure of relays 54 and 56.

To facilitate system repair in the event of a malfunction, a diagnostic test position is provided. To this end, output line 135 of matrix switch 125 is connected to the cathode of an LED 141, the anode of which is connected to the DC supply voltage $+V_{DC}$. When one of the switch position selectors 136–139 is set to a position wherein output line 135 is electrically joined with one or more of the outputs of optical isolators 71–74, actuation of the particular optical isolator(s) applies a low voltage to the cathode of LED 141 which then becomes forward biased. This provides a visual indication that the input channel(s) associated with the particular optical isolator(s) is functioning properly. An additional LED 142 is connected across the DC supply voltage, as is a bypass capacitor 143, and functions to provide a visual indication that power is applied to controller 10.

To enable controller 10 to rapidly shut down operation of the electrical devices in the event of an emergency, controller 10 includes an additional full-wave bridge rectifier 144 and optical isolator 146. One input of bridge rectifier 144 is connected to the neutral side of the AC power source 51, while the other input is coupled through the normally closed contacts of emergency shut-off switch 66 and through a resistor 157 to a "hot" side L1 of the AC Power source. The outputs of bridge rectifier 144 are connected through a diagnostic LED 152 to the input of optical isolator 146, and the output of optical isolator 146 is coupled through a first resistor 147 to the DC supply voltage and through a second resistor 148 to the base electrode of a Darlington transistor pair 149. The emiter of transistor 149 is connected to the DC supply voltage and the collector is coupled through a resistor 151 to circuit ground. A forward biased LED 153 is connected across resistor 151 and a filter capacitor 154 is connected across the output terminals of bridge rectifier 144.

As long as the contacts of the emergency shut-off switch 66 remain closed, optical isolator 146 remains actuated and the base of the Darlington transistor pair 149 is grounded through resistor 148. The transistor is thereby biased on and the DC supply voltage is coupled through the transistor and appears at the juncture of the transistor collector and the resistor 151. The voltage appearing at the juncture of the transistor collector and resistor 151 is coupled to the relay driver 120 and functions to enable each of the relay driver amplifiers 121–124. The voltage also actuates LED 153 to provide a visual indication that the relay driver is enabled. LED 152 is also actuated as long as switch 66 remains closed to provide a visual indication of proper circuit operation.

In the event the contacts of the emergency shut-off switch 66 open, the voltage at the output of optical isolator 146 rises with the effect that transistor 149 is biased off. When this occurs, the voltage across resistor 151 drops, with the further effect that relay driver 120 becomes disabled and LED 153 is biased off. When relay driver 120 is so disabled, actuation of the electrical devices, connected to the controller output terminals 61–64 and 116–119, is prevented regardless of the position of the dispenser control switches 28, 29, 33 and 34. To bypass the emergency shut-off feature, a switch 156 is connected across the DC supply voltage and the collector of transistor 149. When switch 156 is closed, the DC supply voltage is applied directly to relay driver 120 and thereby enables the relay driver regardless of the position of emergency shut-off switch 66.

To provide a visual indication that proper supply voltage is being supplied, the controller further includes a line voltage monitor 158 coupled to the input of DC power supply 69, which includes an LED (not shown). Preferably, the line voltage monitor is constructed similarly to the emergency shut-off circuitry which includes rectifier 144, capacitor 154 and LED 152.

It will be appreciated that the controller 10 provides a flexible and effective means for selectively operating various electrical devices in accordance with a plurality of control inputs. Although, in the embodiment shown and described, the capability exists for operating four independent electrical devices in accordance with control inputs received from four independent control input sources, it will be appreciated that additional, substantially identical control channels can be included to accomodate a greater or lesser number of control input sources and electrical devices. Furthermore, through selection of an appropriate matrix switch 125, the circuit can be easily configured such that relatively few control input sources control the actuation of a relatively large number of electrical devices or, in the alternative, such that relatively many control input source control actuation of relatively few electrical devices. Additionally, although the circuitry is preferably implemented through the use of CMOS semiconductor devices, it will be appreciated that other semiconductor devices can be successfully employed. Finally, although the controller has been described in the context of an automotive filling station, it will be appreciated that the invention is well suited for other applications wherein it is desired to control various electrical devices in accordance with various control inputs while maintaining electrical isolation among the many control inputs.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. An electrical controller for controlling a plurality of electrical devices in accordance with control inputs received from a plurality of control input sources, said controller comprising:

isolating means coupled to the control input sources for electrically isolating the control input sources from each other and for developing a plurality of individual control voltages corresponding to the individual control inputs developed by the individual control input sources;

a plurality of output means for actuating individual ones of the electrical devices in response to the development of said control voltages; and selector means for selectively coupling said isolating means to individual ones of said output means to apply said control voltages to said output means and thereby actuate individual ones of the electrical devices in response to the development of control inputs by selected ones of the control input sources.

2. An electrical controller as defined in claim 1 wherein said isolating means comprises a plurality of optical isolators associated with individual ones of the control input sources.

3. An electrical controller as defined in claim 2 wherein said selector means includes a plurality of inputs and a plurality of outputs and a plurality of user-actuable switch position selectors for coupling selected ones of said inputs to selected ones of said outputs.

4. An electrical controller as defined in claim 1 wherein said output means includes a plurality of relays coupled to said outputs of said selector means and actuable in response to said control voltages applied to said selector means in accordance with the position of said switch position selectors.

5. An electrical controller as defined in claim 4 further comprising emergency shut-off means for deactivating the electrical devices regardless of the presence or absence of a control input from one or more of the control input sources.

6. An electrical controller as defined in claim 4 wherein said isolating means further comprises a plurality of full wave bridge rectifiers having inputs coupled to said control input sources and having outputs coupled to said optical isolators.

7. An electrical controller as defined in claim 5 wherein said selector means comprises a user-actuable matrix switch.

8. An electrical controller for controlling a plurality of electrical devices in accordance with control inputs received from a plurality of control input sources, said controller comprising:

a plurality of optical isolators having inputs adapted to be coupled to the control input sources and having outputs electrically isolated from said inputs, said optical isolators being operable to develop at said outputs logic transitions in response to the control inputs received from the control input sources;

a user-actuable matrix switch having a plurality of input lines individually coupled to said outputs of said optical isolators and having a plurality of output lines, said matrix switch further including a plurality of user-actuable switch position selectors for selectively coupling individual ones of said input lines to individual ones of said output lines; and a plurality of relays individually coupled to individual ones of said output lines and having switch contacts actuable in response to said logic transitions occurring at said outputs of selected ones of said optical isolators in accordance with control inputs received from selected ones of the control input sources.

9. An electrical controller as defined in claim 8 wherein said opitcal isolators are coupled to the control input sources through a plurality of full-wave bridge rectifiers.

10. An electrical controller as defined in claim 8 wherein said logic transitions comprise a voltage level change at the output of one or more of said optical isolators.

11. An electrical controller as defined in claim 8 further comprising an LED coupled to one of said optical isolators for providing a visual indication of the presence of one of the control inputs.

12. An electrical controller as defined in claim 8 wherein said matrix switch includes an LED and an additional output line coupled to said LED for providing a visual indication of the occurrence of logic transition at the output of one of said optical isolators when said output is coupled to said additional output line.

13. For use in a vehicular filling station having a plurality of fuel storage tanks, a plurality of electrically operated pumps associated with individual ones of the fuel storage tanks, and a plurality of dispenser control switches individually operable to develop a control current, an electrical controller for selectively controlling actuation of selected ones of the electrically operated pumps in accordance with the control currents developed by particular ones of the dispenser control switches, said controller comprising:

a plurality of optical isolators having inputs adapted to be coupled to the dispenser control switches and having outputs electrically isolated from said inputs, said optical isolators being operable to develop at said inputs logic transitions in response to the control currents provided by the dispenser control switches;

a user-actuable matrix switch having a plurality of input lines individually coupled to said outputs of said optical isolators and having a plurality of output lines, said matrix switch further including a plurality of user-actuable switch position selectors for selectively coupling individual ones of said input lines to individual ones of said output lines; and a plurality of relays individually coupled to individual ones of said output lines and having switch contacts adapted to be coupled to individual ones of the electrically operated pumps and actuable in response to said logic transitions occurring at said outputs of said selected ones of said optical isolators to actuate individual ones of said electrically operated pumps in accordance with control currents received from selected ones of the dispenser control switches.

14. An electrical controller as defined in claim 13 wherein said controller further comprises a plurality of full-wave bridge rectifiers for coupling said optical isolators to the dispenser control switches.

15. An electrical controller as defined in claim 13 wherein each of said logic transitions comprises a voltage level change at the output of one of said optical isolators.

16. An electrical controller as defined in claim 13 further comprising an LED coupled to one of said optical isolators for providing a visual indication of the presence at said optical isolator of one of the control currents.

17. An electrical controller as defined in claim 13 wherein said matrix switch includes an LED and an additional output line coupled to said LED for providing a visual indication of the occurrence of a logic transition at the output of one of said optical isolators when said output is coupled to said additional output line.

* * * * *

UNITED STATES PATENT AND TRADEMARK OFFICE

CERTIFICATE OF CORRECTION

PATENT NO. : 4,719,532

DATED : January 12, 1988

INVENTOR(S) : Russell E. Schneider

It is certified that error appears in the above-identified patent and that said Letters Patent is hereby corrected as shown below:

Column 10, line 19, the word "inputs" should read -- outputs --.

Signed and Sealed this

Second Day of August, 1988

*Attest:*

DONALD J. QUIGG

*Attesting Officer*

*Commissioner of Patents and Trademarks*